United States Patent [19]

Gural et al.

[11] 3,957,929

[45] May 18, 1976

[54] CARBURETOR HAVING PRIMING MEANS

[75] Inventors: John A. Gural, Pittsford; John W. Moulds, Penfield, both of N.Y.

[73] Assignee: General Motors Corporation, Detroit, Mich.

[22] Filed: May 9, 1974

[21] Appl. No.: 468,439

[52] U.S. Cl. ..... 261/34 A; 261/50 A; 261/52

[51] Int. Cl.[2] ..... F02M 7/08

[58] Field of Search ..... 261/34 A, 50 A, 52

[56] References Cited

UNITED STATES PATENTS

| | | | |
|---|---|---|---|
| 2,732,193 | 1/1956 | Wentz, Jr. | 261/34 A |
| 2,744,736 | 5/1956 | Evinrude | 261/34 A |
| 3,290,023 | 12/1966 | Sarto | 261/34 A |
| 3,334,874 | 8/1967 | Stettner | 261/34 A |
| 3,680,846 | 8/1972 | Bickhaus et al. | 261/DIG. 56 |
| 3,802,671 | 4/1974 | Klutho | 261/34 A |
| 3,841,281 | 10/1974 | Mick | 261/50 A |

*Primary Examiner*—Tim R. Miles
*Attorney, Agent, or Firm*—Charles K. Veenstra

[57] ABSTRACT

In an air valve carburetor, additional fuel for cold start enrichment is provided by a primer pump operated by the throttle when the throttle is opened completely. The primer pump discharges through a jet traversed by the air valve, and the air valve is opened partially to expose the jet when the throttle is opened completely.

1 Claim, 5 Drawing Figures

CARBURETOR HAVING PRIMING MEANS

This invention relates to carburetors for internal combustion engines and, more particularly, to air valve carburetors having primer pumps for providing manually operable means for starting enrichment.

In the air valve carburetor described in Ser. No. 343,553, filed Mar. 21, 1973, now U.S. Pat. No. 3,882,206, a thermostat moved the metering linkage to lift the metering rod and to provide an increased lever arm between the air valve and the metering rod. That construction permitted increased flow when the engine was cold and provided primary enrichment for cold start. However, in exceptional cases the amount of additional fuel provided by that construction may be insufficient to enrich the mixture to the extent required for starting.

Accordingly, it is desirable to provide some manually operable means by which an operator can inject an additional quantity of fuel into the mixture conduit prior to starting. Prior art accelerator pumps have been used to achieve cold start enrichment. However, the prior art practice was to have the accelerator pump move whenever the throttle was moved, its main purpose having been to provide extra fuel whenever the throttle was opened for acceleration. Thus whenever the throttle was opened slightly, the accelerator pump would provide additional fuel. In the aforementioned air valve carburetor, however, use of an accelerator pump has not been found necessary when the throttle is opened only slightly and its use could detrimentally affect economical operation of the engine.

It is a principal object of the present invention to provide an air valve carburetor having a primer pump effective to deliver fuel to mixture conduit only when the throttle approaches its wide open position.

Of course, for the most effective operation the primer pump must discharge into the controlled pressure region of the mixture conduit between the air valve and the throttle. This region is maintained at a pressure lower than that of the carburetor fuel bowl, and thus an air bleed into the pump discharge passage is required to prevent siphoning of fuel through the discharge passage. While such an air bleed is a conventional part of an accelerator pump system, in an air valve carburetor such a continuous air bleed into the controlled pressure region would increase the pressure and reduce fuel flow during closed air valve, idling operation.

Thus it is a further object of this invention to provide an air valve carburetor having a primer pump effective to deliver fuel to the controlled pressure region without adversely affecting the pressure in that region.

In many air valve carburetors, a lost motion connection between the throttle and the air valve slightly opens the air valve as the throttle approaches its wide open position. This invention advantageously employs such a construction by providing a carburetor having a primer pump which discharges through a jet traversed by the air valve as the air valve is opened through the lost motion connection with the throttle. When the air valve is closed, as for idling, the discharge jet is above the air valve to preclude air flow from the pump siphon break air bleed into the controlled pressure region between the air valve and the throttle. As the air valve is opened through the connection with the throttle, the air valve traverses the discharge jet to permit fuel delivery from the primer pump into the region below the air valve.

This invention provides a carburetor having a primer pump assembly which resembles in many respects, a conventional accelerator pump mechanism. In the preferred embodiment, the primer pump assembly comprises a primer pump plunger reciprocably disposed in a pump well within the carburetor. A return spring urges the plunger toward an uppermost position so that fuel may flow from the fuel bowl through a slot in the pump well to the discharge portion of the well for subsequent pump strokes. A lost-motion linkage between the throttle and a stem for actuating the plunger moves that stem downwardly only when the throttle approaches its wide open position. This in turn causes a duration spring to move the plunger downwardly so that fuel is delivered at a controlled rate from the discharge portion, past a check valve and through a jet into the air inlet. At the same time, the air valve is pulled to a slightly open position by the throttle and traverses the jet to permit discharge of the priming fuel therebelow.

By opening the throttle completely a number of times, the operator may obtain additional fuel to augment the primary starting enrichment normally provided with a conventional air valve carburetor. Therefore, this invention provides novel manually operable means for augmenting starting enrichment, for example, when the engine is cold.

The details as well as the other objects and advantages of this invention are set forth in the remainder of the specification and are shown in the drawings in which.

Figure 1:
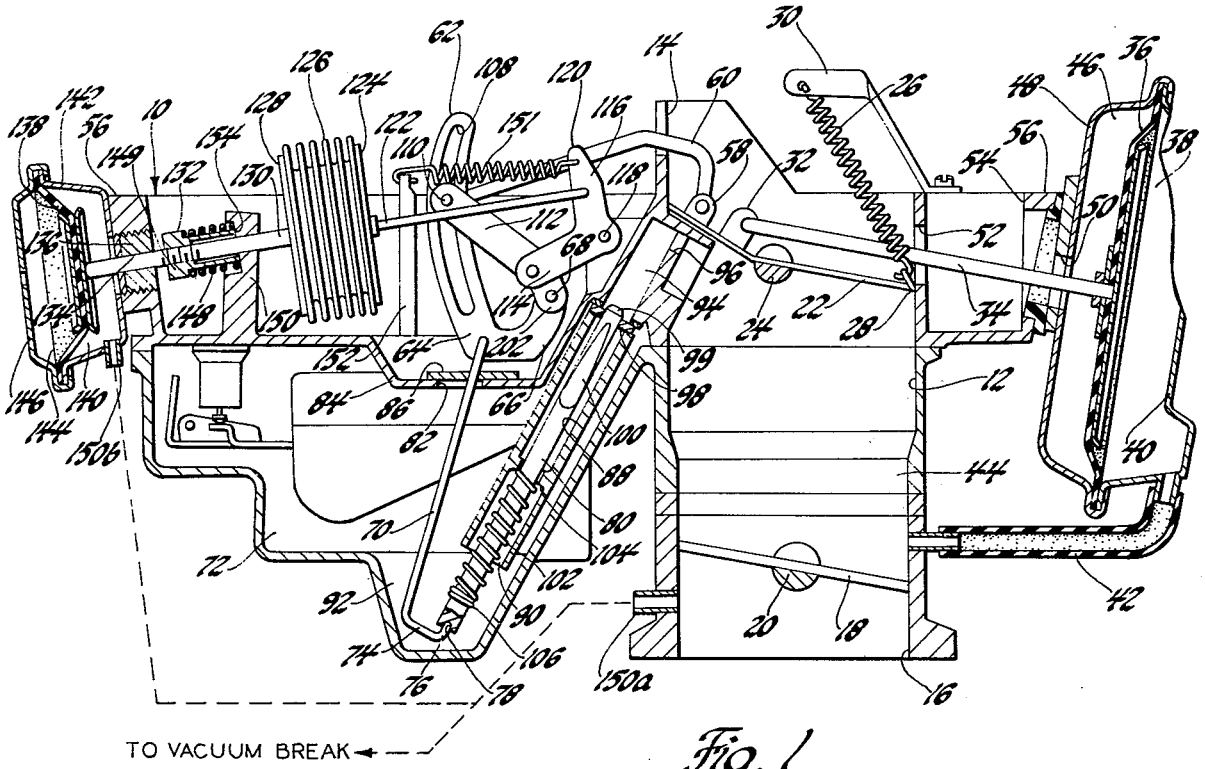
FIG. 1 is a sectional elevational view of the carburetor showing the basic metering linkage and further showing the controls responsive to ambient air pressure and temperature and manifold vacuum and illustrating a portion of the linkage responsive to engine operating temperature.

Referring first to FIG. 1, the carburetor 10 has a mixture conduit 12 including an air inlet 14 and a mixture outlet 16 which discharges to the engine. A throttle 18 is disposed in mixture outlet 16 in the usual manner on a throttle shaft 20.

An air valve 22 is disposed in air inlet 14 on an air valve shaft 24. A spring 26 is attached to the downstream edge 28 of air valve 22 and extends to a bracket 30 to bias valve 22 to the position shown.

A tang 32 reaches upwardly from air valve 22 and is connected by a link 34 to a diaphragm 36. A chamber 38, formed between the right side of diaphragm 36 and a cover member 40, is connected by a tube 42 to a region 44 of mixture conduit 12 defined between air valve 22 and throttle 18.

A chamber 46, defined between the left side of diaphragm 36 and a cover member 48, is subjected to the substantially atmospheric pressure, present in air inlet 14 and in the air cleaner (not shown), through openings such as 50, 52, and 54. (The air cleaner seats on a rim 56 disposed about the upper portion of carburetor 10.)

In operation, chamber 38 is subjected to the subatmospheric pressure created in region 44 as throttle 18 is opened, and diaphragm 36 acts through link 34 to pull air valve 22 clockwise to an open position. Spring 26 is effective to balance the opening force of diaphragm 36, thereby creating a substantially constant subatmospheric pressure in region 44. By thus establishing a generally constant pressure drop across air valve 22, the area about air valve 22 and thus the rotative position of air valve 22 is determined by and is a measure of the rate of air flow through mixture conduit 12.

A tab 58 extends upwardly from air valve 22 and is connected through a link 60 to one end 62 of a lever 64. The opposite end 66 of lever 64 is pivoted about a pin 68. Intermediate ends 62 and 66, a hanger 70 extends from lever 64 into the carburetor fuel bowl 72. The lower end 74 of hanger 70 has a hook 76 which is received in the recess 78 formed in the metering rod 80.

It may be noted that hanger 70 extends through an opening 82 in a cover 84 for fuel bowl 72. Opening 82 is closed by a slider 86 which shifts horizontally during movement of hanger 70.

Metering rod 80 is disposed in a fuel passage 88 having its lower end 90 disposed to receive fuel from a well 92 formed in the bottom of the fuel bowl 72. The upper end 94 of fuel passage 88 has an opening 96 through which fuel is discharged into region 44 of mixture conduit 12. It will be appreciated, therefore, that the fuel in fuel bowl 72 is subjected to a substantially constant metering head — from the substantially atmospheric pressure in the upper portion of the fuel bowl 72 to the generally constant pressure in region 44.

A metering jet or orifice 98 is disposed in fuel passage 88 around the tip 99 of metering rod 80. Metering rod 80 has flat tapered surfaces 100 on opposite sides which, upon reciprocation of metering rod 80 in jet 98, vary the area available for fuel flow through jet 98.

In operation, as air valve 22 opens by clockwise rotation, link 60 rotates lever 64 in a clockwise direction. Lever 64 then lifts hanger 70 to move metering rod 80 generally upwardly and rightwardly in fuel passage 88. Thus as air valve 22 is opened to increase the area available for air flow through air inlet 14, metering rod 80 is shifted to increase the area available for fuel flow through metering orifice 98. By this means, a substantially constant air-fuel ratio may be maintained — the precise proportion being controlled by the geometry of tapered surfaces 100 and of the linkage between air valve 22 and metering rod 80.

A spring 102 extends from a ledge 104 formed in fuel passage 88 to the lower end 106 of metering rod 80 to take up any slack in the linkage and to urge metering rod 80 against jet 98.

A slot 108 is formed in the end 62 of lever 64. Link 60 is connected to lever 64 by having one end 110 disposed in slot 108. A link 112 extends from end 110 to an arm 114 of a supplementary lever 116 pivoted at a pin 118. The opposite arm 120 of lever 116 is connected by a link 122 to one end 124 of an aneroid 126.

The opposite end 128 of aneroid 126 is connected to a reciprocable plunger 130 threadedly received by an adjusting screw 132, guided in the bore 134 of an adjustable stop 136, and extending to a diaphragm 138.

A chamber 140 defined between the right side of diaphragm 138 and a cover member 142 is subjected to the manifold vacuum in mixture outlet 16 downstream of throttle 18, while a chamber 144 defined between the left side of diaphragm 138 and a cover member 146 is subjected to atmospheric pressure. The resulting rightward bias on diaphragm 138 is resisted by a spring 148 disposed between the head 149 of adjusting screw 132 and a support 150. The linkage is shown in the position assumed when manifold vacuum occurring at port 150a opening from mixture outlet 16 and communicated to chamber 140 via fitting 150b is sufficient to overcome the force of spring 148.

When throttle 18 is opened and manifold vacuum drops to a point indicative of the need for an enriched air-fuel ratio, spring 148 moves adjusting screw 132 leftwardly until head 149 engages adjustable stop 136. Link 130 is thus moved leftwardly, and a spring 151, extending between end 120 of supplementary lever 116 and a support 152, moves supplementary lever 116 counterclockwise to move link 122 and aneroid 126 leftwardly. Link 112 is then pulled downwardly to reposition end 110 of link 60 in slot 108, thereby resulting in a shorter lever arm defined between end 110 of link 60 and pivot pin 68. This increases the travel of metering rod 80 through metering jet 98 for equivalent opening movement of air valve 22 to provide an enriched air-fuel mixture.

When manifold vacuum increases to a point indicative of a need for a leaner air-fuel ratio, diaphragm 138 forces link 130 and adjusting screw 132 rightwardly until the end 154 of adjusting screw 132 engages support 150. This forces aneroid 126 and link 122 rightwardly resulting in clockwise rotation of lever 116. Link 112 then raises the end 110 of link 60 in slot 108 to increase the lever arm defined between link end 110 and pivot pin 68. This reduces the travel of metering rod 80 through metering jet 98 for equivalent opening of air valve 22 to provide a lean air-fuel mixture.

The responsiveness of aneroid 126 to variation in ambient air pressure or ambient air temperature and its control of the lever arm link defined between end 110 and pivot 68 to vary the air-fuel ratio is described in the aforementioned copending application and will not be repeated here.

Figure 2:
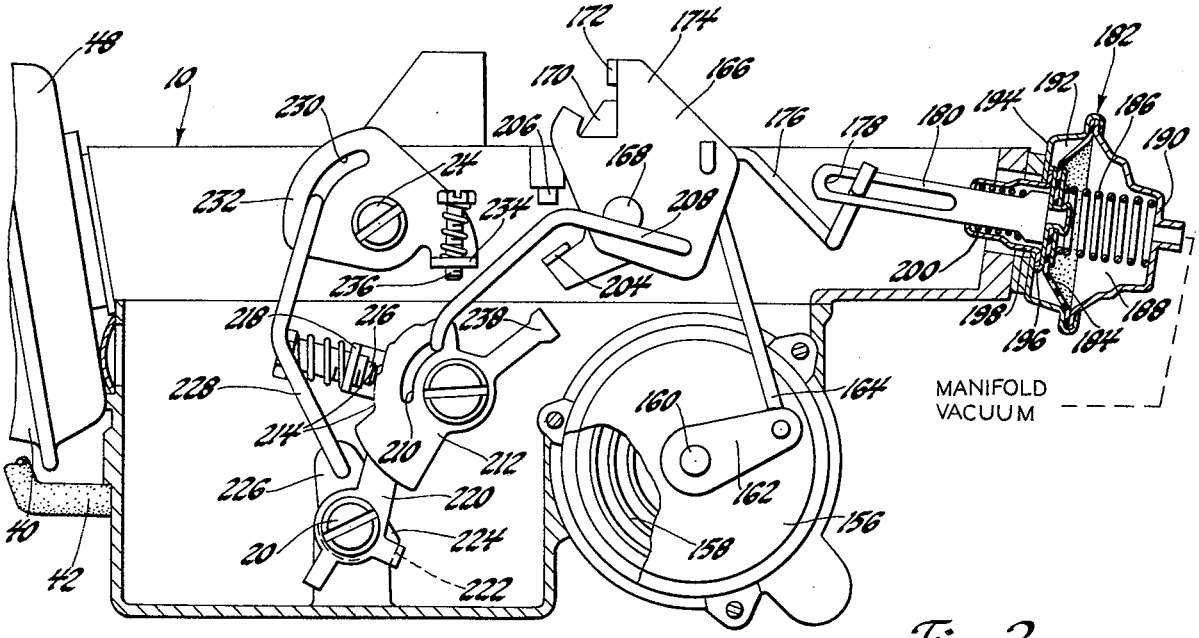
FIG. 2 is a side elevational view of the carburetor with parts broken away to illustrate the remainder of the linkage responsive to engine operating temperature.
Figure 3:
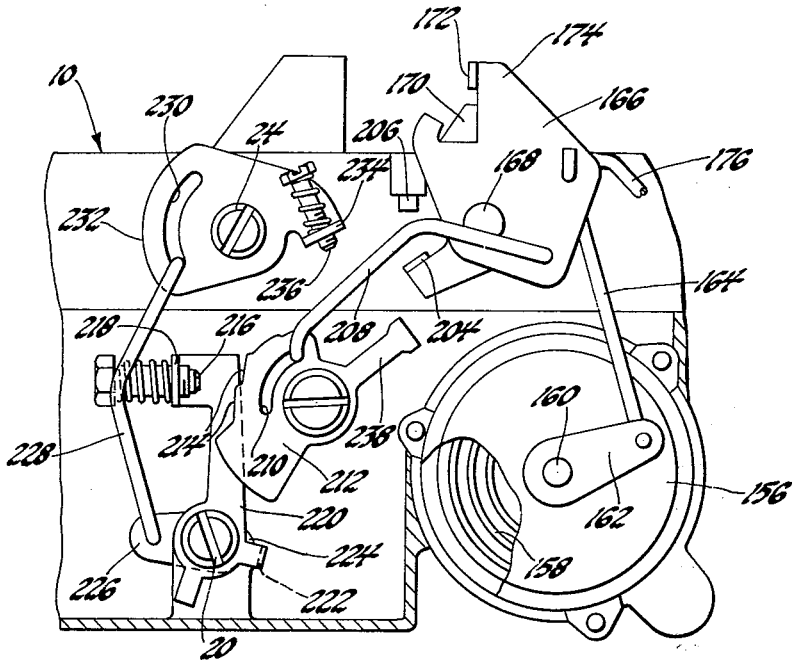
FIG. 3 is a view similar to FIG. 2 illustrating the linkage position when the throttle is opened completely.

Referring now to FIGS. 2 and 3, the housing 156 encloses a thermostat 158 subjected to engine operating temperature—for example, by passing air in heat exchange relationship with engine exhaust gases and then through engine housing 156. Thermostat 158 positions a shaft 160 to which a thermostat lever 162 is secured. A link 164 extends from thermostat lever 162 to an intermediate lever 166 pivotally mounted about a cold enrichment shaft 168.

A vacuum break lever 170 is secured to cold enrichment shaft 168 behind intermediate lever 166 as shown in FIG. 2 and has a tang 172 engaged by an arm 174 of lever 166. A link 176 extends from vacuum break lever 170 and is received in a slot 178 formed in the plunger 180 of the vacuum break unit 182.

Vacuum break unit 182 includes a diaphragm 184 biased toward the position shown by a spring 186. A chamber 188, defined between the right side of diaphragm 184 and a cover member 190, is subjected to the manifold vacuum in mixture outlet 16 downstream of throttle 18. A chamber 192, defined between the left side of diaphragm 184 and a cover member 194, is subjected to atmospheric pressure. As soon as the engine starts, or after a suitable time delay provided by conventional vacuum delay units, diaphragm 184 is pulled rightwardly against the bias of spring 186. A washer 196, secured to diaphragm 184, then pulls a cover member 198 toward the right. This compresses a spring 200 to pull plunger 180 toward the right. Link 176 is thus moved rightwardly to rotate vacuum break lever 170 and cold enrichment shaft 168 in a clockwise direction—the degree of rotation being limited by engagement of tang 172 with arm 174 when the force exerted by spring 200 is balanced by the force exerted by thermostat 158. The resulting counterclockwise movement of a cold enrichment lever 202, shown in FIG. 1 and secured to cold enrichment shaft 168, carries pivot pin 68 and thus moves lever 64 to increase the lever arm defined between link end 110 and pivot pin 68. This reduces the travel of metering rod 80 in jet 98 for equivalent movement of air valve 22 and thus leans the air-fuel mixture after the engine starts.

As thermostat 158 is thereafter warmed during engine operation, thermostat lever 162 is rotated clockwise as viewed in FIGS. 2 and 3. Lever 162 then acts through link 164 to rotate intermediate lever 166 clockwise as viewed in FIGS. 2 and 3. This permits further clockwise rotation of vacuum break lever 170 and cold enrichment shaft 168 under the force imparted by vacuum break unit 182 which thus imparts counterclockwise rotation to cold enrichment lever 202 as viewed in FIG. 1. The resulting counterclockwise movement of pivot pin 68, carried by cold enrichment lever 202 on enrichment shaft 168, moves lever 64 with respect to link 60 and thus increases the lever arm defined between the link end 110 and pivot pin 68. This increase in the lever arm reduces the travel in metering rod 80 in jet 98 for equivalent movement of air valve 22 to lean the air-fuel mixture as the engine warms. This will continue as the engine warms until a tang 204 on vacuum break lever 170 engages an adjustable stop 206 as shown in FIGS. 2 and 3.

Figure 5:
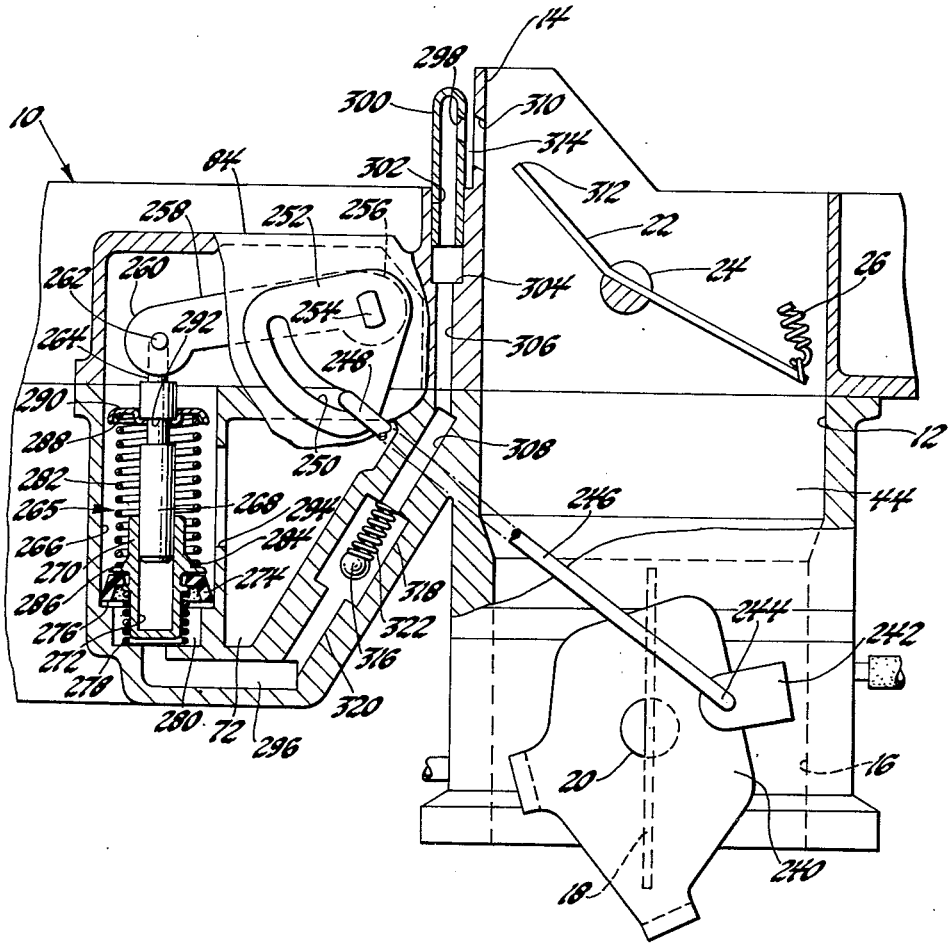
FIG. 5 is a view similar to FIG. 4 showing the position of the primer pump assembly and the air valve when the throttle is opened completely.

As thermostat 158 cools after engine operation, thermostat lever 162 is rotated counterclockwise as viewed in FIGS. 2 and 5. Lever 162 then acts through link 164 to rotate intermediate lever 166 counterclockwise as viewed in FIGS. 2 and 3. At a selected temperature, arm 174 of lever 166 engages tang 172 on vacuum break lever 170 to move lever 170, and cold enrichment shaft 168, counterclockwise away from stop 206 as shown in FIG. 2. This imparts clockwise rotation to cold enrichment lever 202 as viewed in FIG. 1, and the resulting clockwise movement of pivot pin 68 shifts lever 64. As lever 64 is shifted, metering rod 80 is raised to provide increased fuel flow for cold start. In addition, the lever arm defined between link end 110 and pivot pin 68 is decreased to provide increased travel of metering rod 80 in jet 98 for equivalent movement of air valve 22 and thus provides an increased air-fuel mixture for cold operation.

Referring again to FIGS. 2 and 3, a link 208 extends from intermediate lever 166 and is received in a slot 210 of a fast idle cam member 212. Fast idle cam member 212 has a series of steps 214—or alternatively a smoothly contoured surface—engaged by a fast idle adjusting screw 216 carried in a tang 218 on a lever 220 pivoted on throttle shaft 20. Another tang 222 on lever 220 engages an arm 224 of a throttle lever 226 secured to throttle shaft 20. A link 228 extends from throttle lever 226 and is received in a slot 230 of an air valve lever 232 secured to air valve shaft 24. A tang 234 on air valve lever 232 carries an idle mixture adjusting screw 236 which engages an arm 238 on the fast idle cam member 212.

In operation, as the temperature decreases, thermostat 158 rotates thermostat lever 162 counterclockwise to lift link 164 and rotate intermediate lever 166 counterclockwise. Link 208 is then pulled upwardly and toward the right to rotate fast idle cam 212 clockwise. Fast idle adjusting screw 216 is then received on the high step 214 of fast idle cam member 212 to limit clockwise movement — in the throttle closing direction — of lever 220, throttle lever 226 and throttle shaft 20.

As throttle lever 226 is rotated counterclockwise during movement of throttle 18 to its wide open position, link 228 is pulled downwardly and engages the lower end of slot 230 in lever 232 to provide counterclockwise rotation of air valve lever 232 and air valve shaft 24 to assist in opening air valve 22. This feature may be used to unload a flooded engine since, with air valve 22 partially open little if any vacuum is produced in region 44 and fuel flow is thereby minimized.

Figure 4:
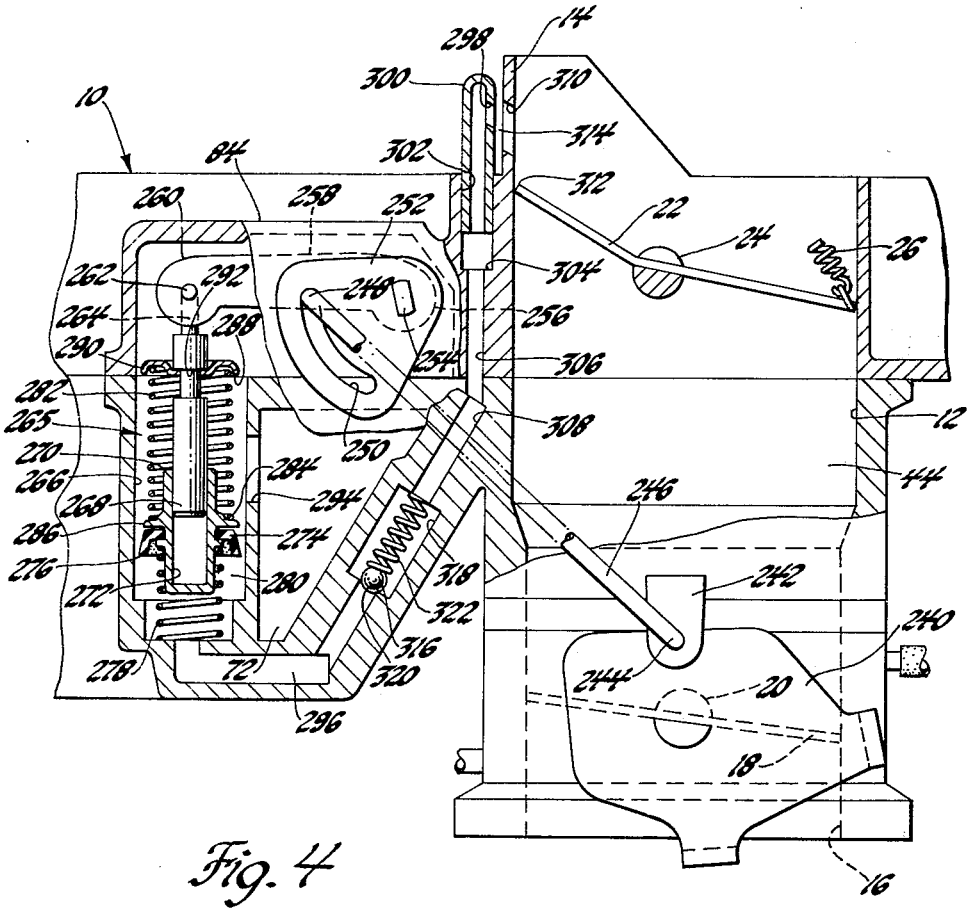
FIG. 4 is a sectional elevational view of the carburetor showing the primer pump assembly and the linkage extending from the throttle to the primer pump assembly.

Referring now to FIGS. 4 and 5, a secondary cold enrichment system provides additional enrichment for cold start in the event that the clockwise rotation of cold enrichment shaft 168, provided by vacuum break unit 180 and thermostat 156, and the resulting repositioning of metering rod 80 in jet 98 is insufficient to provide adequate fuel flow for cold start.

A throttle lever 240, secured to throttle shaft 20 for concomitant rotation with throttle 18, has an arm 242 which receives one end 244 of a link 246. The other end 248 of link 246 is carried in arcuate slot 250 of a lever 252 pivotally mounted on a shaft 254 extending through the cover 84 of fuel bowl 72.

One end 256 of an actuating lever 258 is secured to shaft 254 for concomitant rotation with lever 252. The other end 260 of actuating lever 258 receives a turned end 262 of a pump stem 264 which extends downwardly to a primer pump assembly 265 centrally and reciprocably disposed in a vertical cylindrical pump bore 266 formed adjacent fuel bowl 72.

Slidably disposed on the lower end 268 of stem 264 is a pump plunger 270 having a well portion 272 formed therein which receives the lower end 268 of stem 264. Plunger 270 has a cup seal 274 having a downwardly and outwardly extending skirt 276 which abuts and slides in pump bore 266. Cup seal 274 acts as a fuel check valve in a manner to be described.

Plunger 270 is urged toward its uppermost position as shown in FIG. 4 by a return spring 278, the lower end of which resides in the bottom of bore 266 and the upper end of which abuts the lower side of plunger 270.

The rate of discharge of fuel from the lower or discharge portion 280 of bore 266, formed between plunger 270 and the bottom of bore 266, is controlled in part by a stiff duration spring 282. The lower end 284 of duration spring 282 abuts a flange 286 formed on plunger 270. The upper end 288 of duration spring 282 is restrained by a spring retainer 290 which is urged against a shoulder 292 of pump stem 264.

When plunger 270 is raised in pump bore 266 under the urging of return spring 278, fuel passes through a slot 294 connecting bore 266 and fuel bowl 72 and about the skirt 276 of cup seal 274 into the discharge portion 280 of bore 266 thereby filling the discharge portion with fuel. However, when plunger 270 is lowered, skirt 276 of cup seal 274 is spread outwardly to sealingly abut pump bore 266 thus preventing fuel flow therebetween. In this manner, cup seal 274 acts as a fuel check valve for filling discharge portion 280 with fuel.

A pump discharge passage 296 connects discharge portion 280 to a discharge orifice 298 formed in a closed-end tube 300 which is pressed into a counterbore 302. The bottom 304 of counterbore 302 opens from a vertical bore 306 of passage 296 which in turn opens from an inclined bore 308 of passage 296.

Discharge orifice 298 is aligned with and opens to a pump jet 310 formed in air inlet 14. Pump jet 310 is located adjacent to air valve 22 so that when air valve 22 is closed, the trajectory of fuel discharged from jet 310 is above the air valve but when the air valve is opened, as would occur when the throttle approaches its wide open position and line 228 pulls on air valve lever 232, the fuel discharge trajectory from jet 310 is below the leading edge 312 of air valve 22.

During operation with air valve 22 open, the vacuum in region 44 is applied to the downstream side of pump jet 310. To avoid undesirable fuel pullover from passage 296, a cavity 314 between orifice 298 and jet 310 vents the other side of jet 310 to the atmosphere outside the air inlet 14. Cavity 314 acts as a suction breaker so that fuel will not be pulled out of pump jet 310 into region 44. This suction breaker ensures a full pump discharge when needed and prevents siphoning of fuel from discharge portion 280 through discharge passage 296.

A discharge check ball 316 is disposed in an enlarged cavity 318 formed in inclined bore 308. Check ball 316 is urged against a seat 320 formed around bore 308 by a spring 322 interposed between check ball 316 and the upper end of cavity 318.

During upward movement of primer pump assembly 265 check ball 316 is urged against seat 320 by spring 322 and thereby seals seat 320 so that air will not be drawn into discharge passage 296 and discharge portion 280. However, during downward movement of primer pump assembly 265 fuel flow against ball 316 will unseat it from seat 320 to allow fuel flow through passage 296 and jet 310 to region 44.

Referring to FIG. 4, throttle lever 240, link 246, levers 252 and 258, and pump assembly 265 are in the position shown when the throttle is closed. During initial throttle opening movement, link 246 rides in slot 250 of lever 252 and cannot urge levers 252, 258 counterclockwise to force pump stem 264 and plunger 270 downwardly. Thus, fuel is not discharged from fuel discharge portion 280 past check ball 316 and through jet 310 to metering region 44.

As the throttle is partially opened, lever 240 rotates clockwise and moves link 246 rightwardly and downwardly. Upper end 248 of link 246 will slide downwardly in slot 250 as the throttle is opened until the throttle nears its wide open position. When this happens, link end 248 will engage the lower end of slot 250 in lever 252 to move levers 252, 258 and operate primer pump assembly 265. In the preferred embodiment, the primer pump is moved by the throttle during the last 20° of throttle travel.

As lever 252, shaft 254, and actuating lever 258 rotate counterclockwise to a position as shown in FIG. 5, actuating lever 258 moves pump stem 264 downwardly. Spring retainer 290, secured to the pump stem, is simultaneously moved downwardly and the increased downward bias of duration spring 282 is sufficient to overcome the upward urging of return spring 278 and move pump plunger 270 downwardly in discharge portion 280.

As this occurs skirt portion 276 of cup seal 274 flares outwardly under the fluid and inertial resistance of the fuel in discharge portion 280 thereby sealing the skirt against pump bore 266 to prevent fuel flow therebetween. As plunger 270 continues to move downwardly under the urging of duration spring 282, fuel is displaced from discharge portion 280 through discharge passage 296 and unseats discharge check ball 316 to flow through orifice 298, across cavity 314 and through pump jet 310 into region 44 to impinge upon the underside of air valve 22. Air valve 22 is open as shown in FIG. 5 during operation of primer pump assembly 265 since during counterclockwise throttle opening movement of throttle lever 226 (as viewed in FIGS. 2 and 3), link 228 is pulled downwardly in slot 230 and, at a point near the wide open throttle position, the upper end of link 228 engages the lower end of slot 230 to rotate air valve lever 232 and air valve shaft 24 in the counterclockwise air valve opening direction.

When the throttle is closed, lever 240 raises link 246 and link end 248 in slot 250. Return spring 278 then moves plunger 270, duration spring 282, retainer 290 and stem 264 upwardly and rotates actuating lever 258 and slotted lever 252 clockwise to the position shown in FIG. 4 to enable the primer pump assembly 265 to be effective for subsequent pump strokes.

It should be made apparent that the purpose of the primer pump assembly is for secondary or back-up starting enrichment means when the primary cold start enrichment means provided by the metering linkage and cold enrichment shaft 202 are insufficient to adequately enrich the mixture for cold start. When necessary, the operator may completely open the throttle a number of times during starting to actuate primer pump assembly 265 thereby providing as much additional fuel as desired to start the engine.

Also, it should be noted that the effects of the primer pump and the air valve unloader feature may appear competing in their determination of fuel flow. When the air valve is partially opened at wide open throttle little, if any, vacuum is produced in region 44 and fuel flow is reduced. However, the manually operable primer pump may be actuated a number of times by the operator prior to cranking in order to discharge as much fuel as is necessary to enrich the starting mixture. Then when the throttle is closed to the position determined by fast idle cam member 212, air valve 22 will be closed to establish the necessary vacuum in region 44.

Finally, it should be noted that the location of air valve-traversed jet 310 is important to this invention. Jet 310 is above the air valve when it is closed as shown in FIG. 4, so that no air is bled from cavity 314 into region 44. Otherwise, that bleed air would increase the pressure in region 44 and thus decrease fuel flow.

What is claimed is:

1. A carburetor comprising a mixture conduit having an air inlet, a throttle disposed in said mixture conduit and movable between closed and wide open positions for controlling flow therethrough, an air valve disposed in said mixture conduit anterior said throttle and defining a controlled pressure region therebetween, said air valve being movable between a closed position, an open position and other positions, means positioning said air valve in accordance with the pressure in said region whereby the position of said air valve is a measure of the rate of air flow through said mixture conduit, a fuel bowl, means for supplying fuel from said bowl to said region in accordance with the position of said air valve and the pressure in said region, means defining a lost motion connection between said throttle and said air valve for moving said air valve from said closed position to said open position as said throttle approaches said wide open position, a primer pump chamber disposed adjacent said fuel bowl and having means for receiving fuel from said bowl, a discharge passage extending from said chamber to a jet opening into said mixture conduit, said discharge passage having a cavity exposed to the atmosphere, a primer pump plunger operable in said chamber for discharging fuel from said chamber through said discharge passage and said jet into said mixture conduit, said jet opening into said mixture conduit upstream of said air valve when said air valve is in said closed position and downstream of said air valve when said air valve is in said open position whereby fuel would be discharged upstream of said air valve if said air valve were in said closed position and is discharged into said region when said air valve is in said open position, and means defining a lost motion connection between said throttle and said primer pump plunger for operating said plunger to discharge fuel only as said throttle approaches said wide open position, whereby as said throttle is moved to said wide open position said air valve is moved to said open position and said primer pump plunger is operated to discharge fuel through said jet into said region, and whereby when said air valve is in said closed position said jet is precluded from bleeding air into said controlled pressure region.

* * * * *